US011002475B1

(12) United States Patent
Jackson et al.

(10) Patent No.: US 11,002,475 B1
(45) Date of Patent: May 11, 2021

(54) REFRIGERATION SYSTEM WITH EVAPORATOR TEMPERATURE SENSOR FAILURE DETECTION AND RELATED METHODS

(71) Applicant: ILLINOIS TOOL WORKS INC., Glenview, IL (US)

(72) Inventors: Steven T. Jackson, Fort Worth, TX (US); Charles M. Louis, Fort Worth, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 44 days.

(21) Appl. No.: 16/426,072

(22) Filed: May 30, 2019

(51) Int. Cl.
*F25D 21/00* (2006.01)
*F25D 21/02* (2006.01)
*F25D 21/08* (2006.01)

(52) U.S. Cl.
CPC ..... *F25D 21/006* (2013.01); *F25D 21/02* (2013.01); *F25B 2700/11* (2013.01); *F25B 2700/2117* (2013.01); *F25D 21/08* (2013.01)

(58) Field of Classification Search
CPC ..... F25B 2700/11; F25B 2700/2117; F25D 21/00; F25D 21/002; F25D 21/006; F25D 21/02; F25D 21/06
See application file for complete search history.

(56) References Cited

U.S. PATENT DOCUMENTS

| | | | | |
|---|---|---|---|---|
| 4,535,600 | A | 8/1985 | Gelbard | |
| 4,903,500 | A | 2/1990 | Hanson | |
| 8,161,758 | B2 | 4/2012 | Bailey | |
| 8,250,875 | B2 | 8/2012 | Rafalovich | |
| 8,365,541 | B2 | 2/2013 | Hanley | |
| 8,739,563 | B2 | 6/2014 | Coussey | |
| 8,997,507 | B2 | 4/2015 | Boarman | |
| 9,188,381 | B2 | 11/2015 | Derosier | |
| 9,285,153 | B2 | 3/2016 | Contreras Lafaire | |
| 9,551,523 | B2 | 1/2017 | Dauria | |
| 9,823,010 | B2 | 11/2017 | Boarman | |
| 9,995,515 | B2 | 6/2018 | Liu | |
| 2008/0092569 | A1* | 4/2008 | Doberstein | F25D 21/006 62/156 |

(Continued)

*Primary Examiner* — Jonathan Bradford
(74) *Attorney, Agent, or Firm* — Thompson Hine LLP

(57) ABSTRACT

A method of automatically controlling a refrigerated device that includes a refrigeration system with an evaporator and an evaporator temperature sensor involves: (a) monitoring an output of the evaporator temperature sensor; (b) based upon monitored temperatures from (a), identifying when a rate of change in temperature indicated by the evaporator temperature sensor satisfies a set rate of change condition and determining if the temperature indicated by the evaporator temperature sensor when the rate of change satisfies to the set rate of change condition is consistent with a predefined expected temperature condition; (c) if the temperature indicated by the evaporator temperature sensor is consistent with the predefined expected temperature condition, taking a first refrigeration control action; and (d) if the temperature indicated by the evaporator temperature sensor is not consistent with the predefined expected temperature condition, taking a second refrigeration control action that is different than the first refrigeration control action.

10 Claims, 7 Drawing Sheets

(56) References Cited

U.S. PATENT DOCUMENTS

| | | | | |
|---|---|---|---|---|
| 2012/0042667 | A1* | 2/2012 | Fulmer | F25D 21/006 62/80 |
| 2014/0139342 | A1* | 5/2014 | Brown | G08B 21/14 340/603 |

* cited by examiner

REFRIGERATION SYSTEM WITH EVAPORATOR TEMPERATURE SENSOR FAILURE DETECTION AND RELATED METHODS

TECHNICAL FIELD

This application relates generally to refrigeration systems and, more specifically, to refrigeration systems that incorporate an evaporator temperature sensor that is utilized during evaporator defrost operations.

BACKGROUND

In a refrigeration system, frost build-up on the evaporator coil during normal use is a well-known problem. As a consequence of the user opening the cabinet door, moist air is introduced which will condense and freeze, forming a frost layer on the evaporator coil. As frost accumulates over time, it will reduce air flow and degrade the temperature performance of the refrigeration system.

Typical refrigeration systems are designed to perform an automated defrost operation periodically to melt frost so it can drip into a catch-pan and flow out of the unit. In the defrost operation, a heat source is introduced to raise the temperature of the evaporator above the freezing point of water. The heat source can be an electric heater, air from a fan or hot gas from the compressor.

In order to determine when to discontinue the application of heat, a temperature sensor is placed in the evaporator coil fins. The temperature sensor measures the coil temperature during defrost and when it exceeds a set point, the heat source is turned off.

If the sensor degrades over time, such that the temperature reading is either higher or lower than the actual temperature, the defrost operation will not perform properly. If the temperature sensor reading is higher than actual, the defrost operation will terminate prematurely, resulting in a partially defrosted evaporator coil. With a partially frosted coil, the cabinet will not cool properly. If the temperature sensor is faulty and reads lower than the actual temperature, the defrost operation will continue longer than is necessary. This results in excess heat which must be removed. The excess heat raises the overall temperature of the cabinet, and causes the refrigeration system to run more than is necessary.

It would be desirable to provide a system and method for detecting a problem with the evaporator temperature sensor so that system control can be modified accordingly to reduce the impact of the faulty sensor on the operation of the system.

SUMMARY

In one aspect, a method is provided for automatically controlling a refrigerated device that includes refrigeration system with an evaporator and an evaporator temperature sensor, where the method involves: (a) monitoring an output of the evaporator temperature sensor; (b) based upon monitored temperatures from step (a), identifying when a rate of change in temperature indicated by the evaporator temperature sensor satisfies a set rate of change condition and determining if a temperature indicated by the evaporator temperature sensor when the rate of change satisfies to the set rate of change condition is consistent with a predefined expected temperature condition; (c) if the temperature indicated by the evaporator temperature sensor is consistent with the predefined expected temperature condition, taking a first refrigeration control action; and (d) if the temperature indicated by the evaporator temperature sensor is not consistent with the predefined expected temperature condition, taking a second refrigeration control action that is different than the first refrigeration control action.

In another aspect, a refrigerated cabinet includes a housing defining a space for holding product, a refrigeration system for cooling the space, the refrigeration system including an evaporator and an evaporator temperature sensor, a heat source for applying heat to the evaporator during an evaporator defrost operation, and a controller for controlling the refrigeration system and the heat source. The controller is configured to: (i) monitor temperatures indicated by the evaporator temperature sensor during the evaporator defrost operation, and (ii) based upon the monitored temperatures, identify a temperature indicated by the evaporator temperature sensor when a rate of change in temperature indicated by the evaporator temperature sensor satisfies a set rate of change condition, and (iii) compare the identified temperature to a predefined expected temperature condition in order to determine whether the evaporator temperature sensor is faulty.

In another aspect, a refrigerated cabinet includes a housing defining a space for holding product, a refrigeration system for cooling the space, the refrigeration system including an evaporator and an evaporator temperature sensor, a heat source for selectively applying heat to defrost the evaporator and a controller for controlling the refrigeration system and the heat source. The controller is configured to monitor temperatures indicated by the evaporator temperature sensor during an evaporator defrost operation and, based upon the monitored temperatures, identify a temperature indicated by the evaporator temperature sensor when a rate of change in temperature indicated by the evaporator temperature sensor falls to a defined level, and compare the identified temperature to a predefined expected temperature condition in order to determine whether the evaporator temperature sensor is faulty.

In another aspect, a method is provided for controlling a refrigeration system that includes an evaporator and an evaporator temperature sensor, where the method involves: (a) initiating an evaporator defrost operation during which heat is applied to defrost the evaporator; (b) monitoring an output of the evaporator temperature sensor during the evaporator defrost operation; (c) based upon monitored temperatures from step (b): (c)(i) identifying a point in time when a rate of change in temperature indicated by the evaporator temperature sensor falls to a set rate of change level; (c)(ii) comparing a temperature indicated by the evaporator temperature sensor at the point in time to a predefined expected temperature condition and, (c)(iia) if the indicated temperature is consistent with the predefined expected temperature condition, identifying a valid temperature state of the evaporator temperature sensor or (c)(iib) if the indicated temperature is not consistent with the predefined expected temperature condition, identifying an invalid temperature state of the evaporator temperature sensor; and (d) either: (d)(i) if the valid temperature state is identified, taking a first refrigeration control action or (d)(ii) if the invalid temperature state is identified, taking a second refrigeration control action.

The details of one or more embodiments are set forth in the accompanying drawings and the description below. Other features, objects, and advantages will be apparent from the description and drawings, and from the claims.

DETAILED DESCRIPTION

Figure 1:
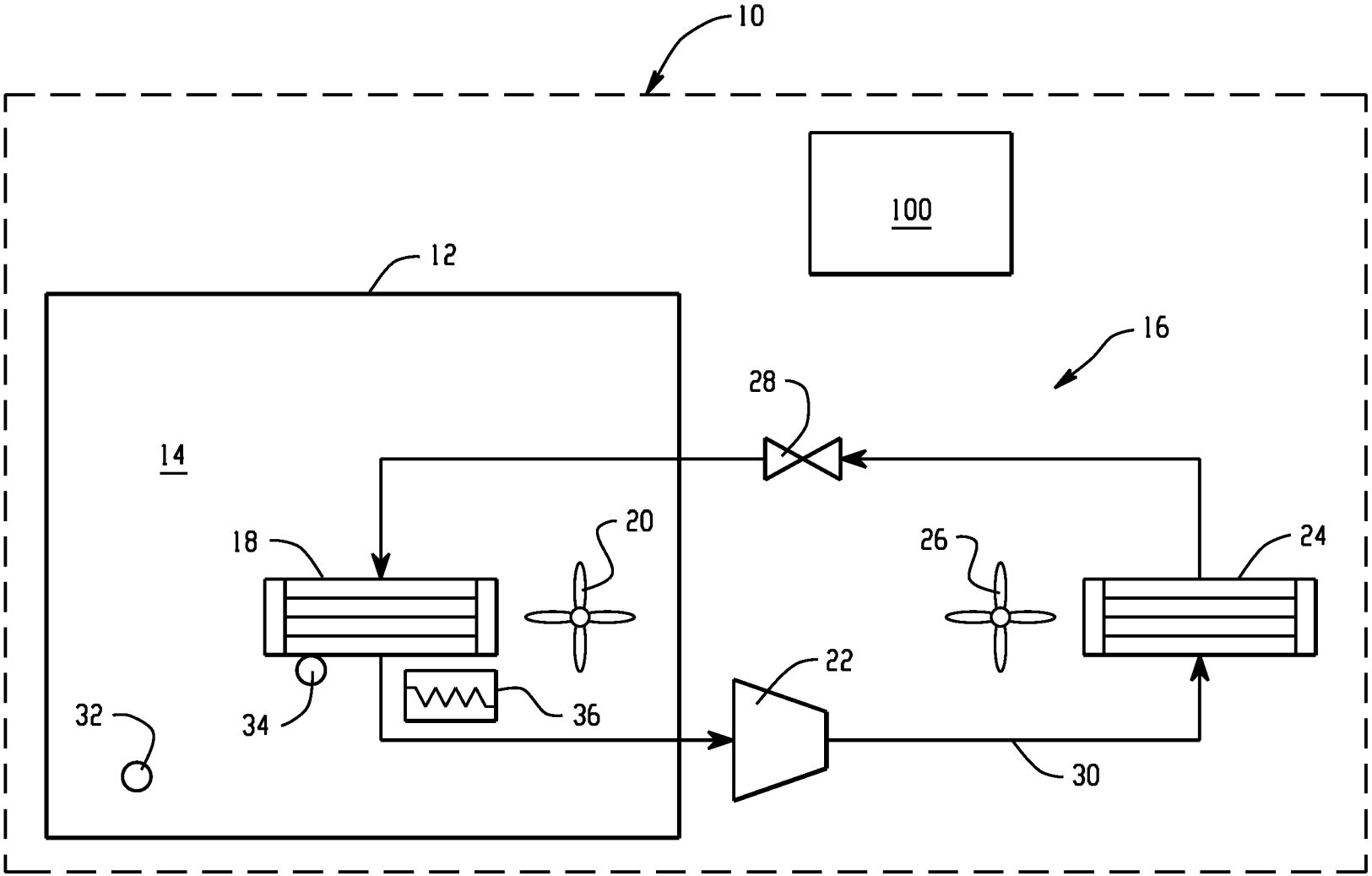
FIG. 1 is a schematic depiction of a refrigerated device.

Referring to FIG. 1, a refrigerated device 10, such as refrigerated cabinet (e.g., refrigerator, freezer, refrigerator/freezer combination, refrigerated display case etc.) is shown, where a cabinet housing 12 defines a refrigerated space 14 that is cooled by a refrigeration system 16 that includes an evaporator 18 and associated fan 20, a compressor 22, a condenser 24 and associated fan 26 and an expansion device 28 all located along a path 30 of refrigerant medium. The evaporator temperature sensor 34 may be installed in the fins of the evaporator, for example, or in any other location likely to accumulate frost and ice during use of the cabinet. The cabinet temperature sensor 32 can be installed inside the cabinet space 14, or in the return air duct that circulates past the evaporator 18, or in any location within the refrigerated space that will serve as the basis for controlling the refrigeration system to cool the space to a desired temperature.

The system also includes a controller 100, a cabinet temperature sensor 32 (positioned to detect the air temperature of the refrigerated space 14), an evaporator temperature sensor 34 (positioned to detect the temperature of the evaporator 18) and a heat source 36 for selectively applying heat to the evaporator 18 for defrost purposes. Here, the heat source 36 is shown as a resistive heating element, but alternative heat sources include air or hot gas. The controller 100 receives inputs from sensors 34 and 32 for refrigeration and defrost control purposes, and is configured to control the refrigeration system, including the compressor 22, fans 20 and 26, and heat source 36.

A typical evaporator defrost operation includes four primary steps, as follows. (1) Apply heat until evaporator coil temperature is above a defrost set point, (2) turn off the heat source and wait for water to drip off the evaporator (variable time set in controller memory), (3) run the compressor to pre-cool the evaporator coil until the evaporator coil temperature is below the pre-cool set point and (4) run the compressor and the evaporator fan until cabinet temperature is below cabinet operating set point.

A temperature sensor can be in one of five states: (1) working properly, (2) faulty—reading higher than actual, (3) faulty—reading lower than actual, (4) Open—complete failure or (5) Short—complete failure.

Detecting an open circuit or short circuit is fairly straightforward and is commonly done in most temperature measurement applications. When a temperature sensor is "faulty", it is reading higher or lower than it should, but still within the range for expected temperatures. For example, the defrost set point or termination temperature may be when the evaporator temperature sensor 34 reads, for example, 42.0° F. If the evaporator temperature sensor is faulty and outputs a signal indicating a temperature that +15.0° F. compared to actual temperature, then the sensor 34 would read 42.0° F. when the actual temperature is only 27.0° F. This would result in terminating the defrost operation while there is still frost on the coil. If the evaporator temperature outputs a signal indicating a temperature that is −15.0° F. compared to actual temperature, then the sensor 34 would read 42.0° F. when the actual temperature is 57° F. This would result in applying excess heat to the evaporator coil, which heat must be removed later when the system begins cooling again. In either case (incomplete defrost of the evaporator or excessive heating of the evaporator), the system will not operate efficiently.

In systems that use a NTC (Negative Temperature Coefficient) thermistor, a common cause of a faulty sensor is silver dendrite electro-migration caused by moisture ingress through the thermoplastic outer sheath or through the overmold. This forms a parallel resistance to the thermistor, lowering the resistance value. On an NTC thermistor, the lower resistance equates to a higher temperature than the actual temperature.

Figure 2:
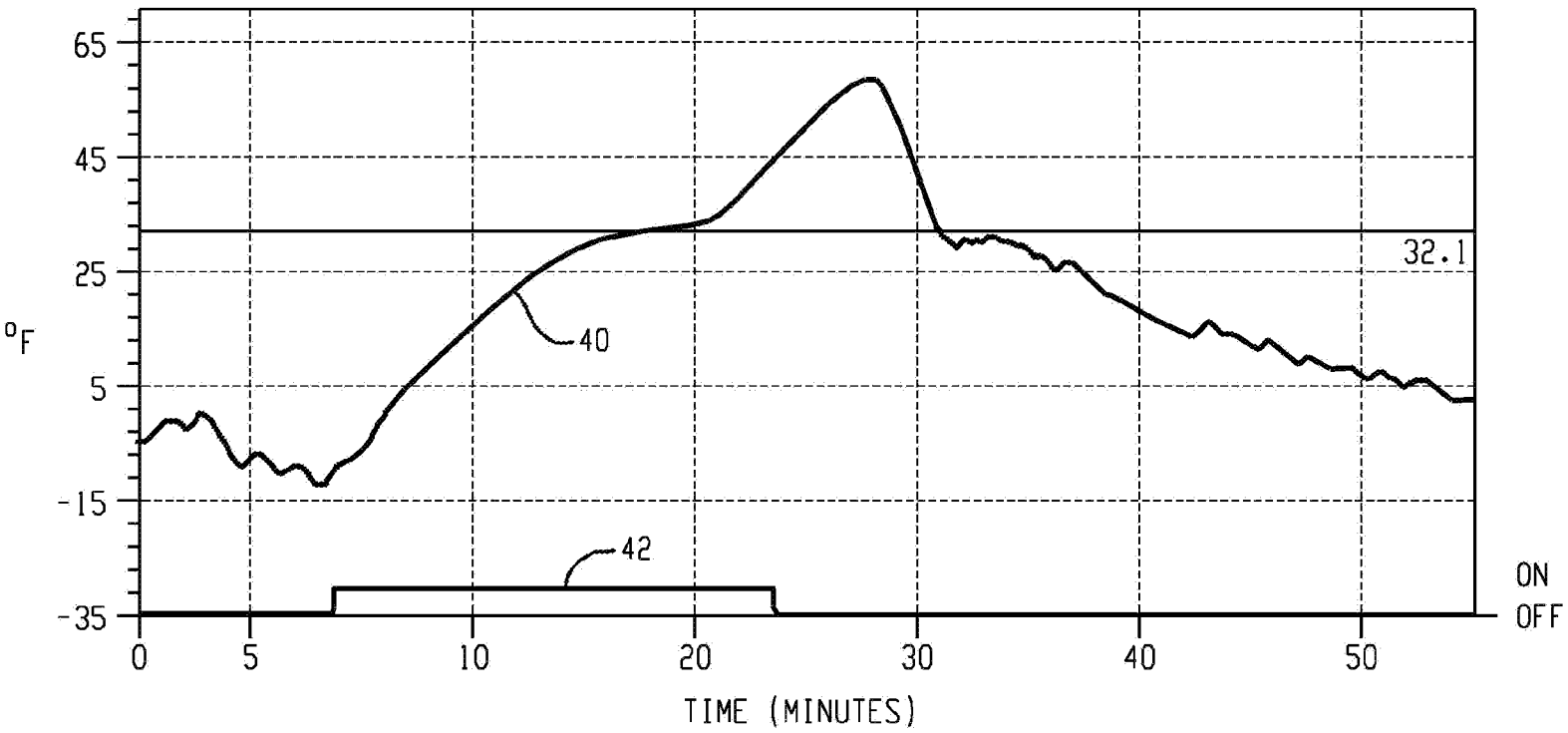
FIG. 2 is a graph of an actual evaporator temperature during a typical defrost operation.
Figure 3:
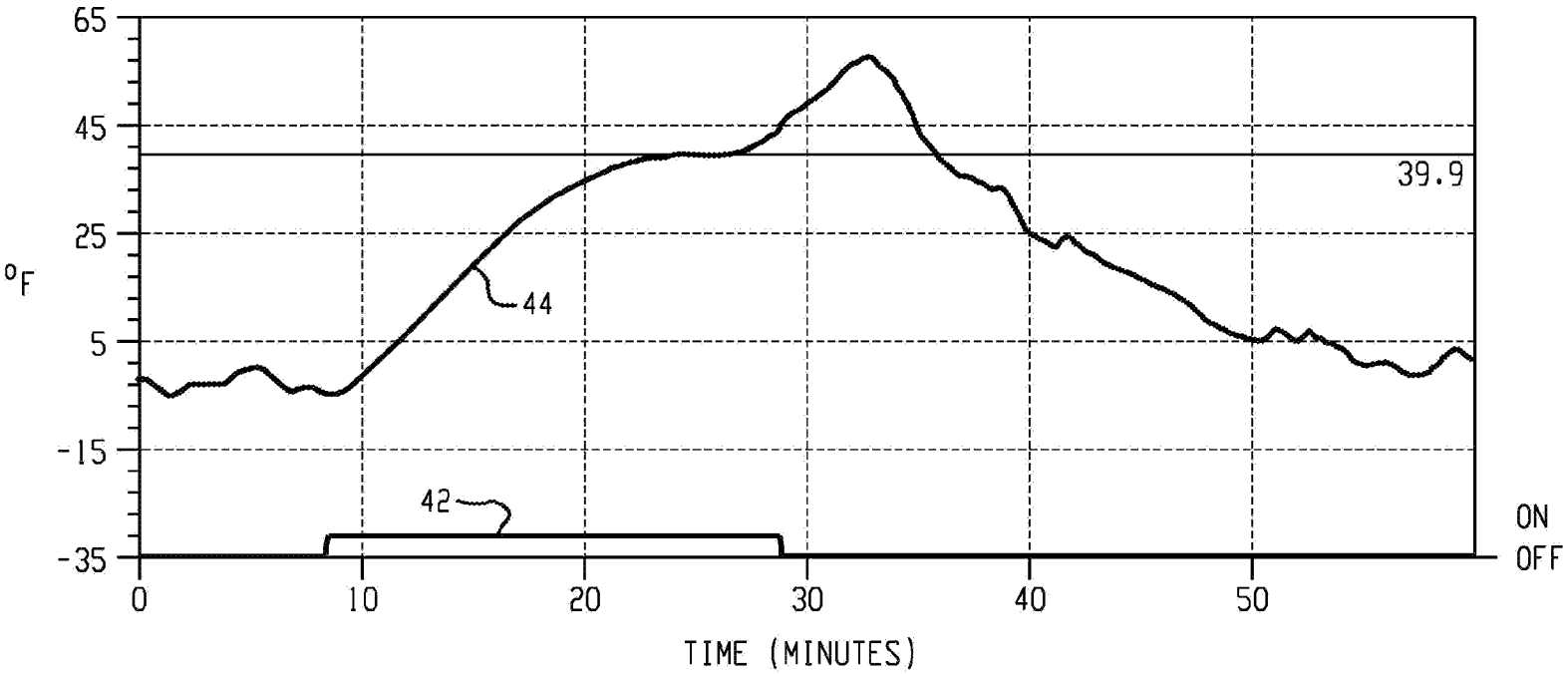
FIG. 3 is a graph of evaporator temperature sensor that may be indicated by a faulty temperature sensor during the same defrost operation.
Figure 4:
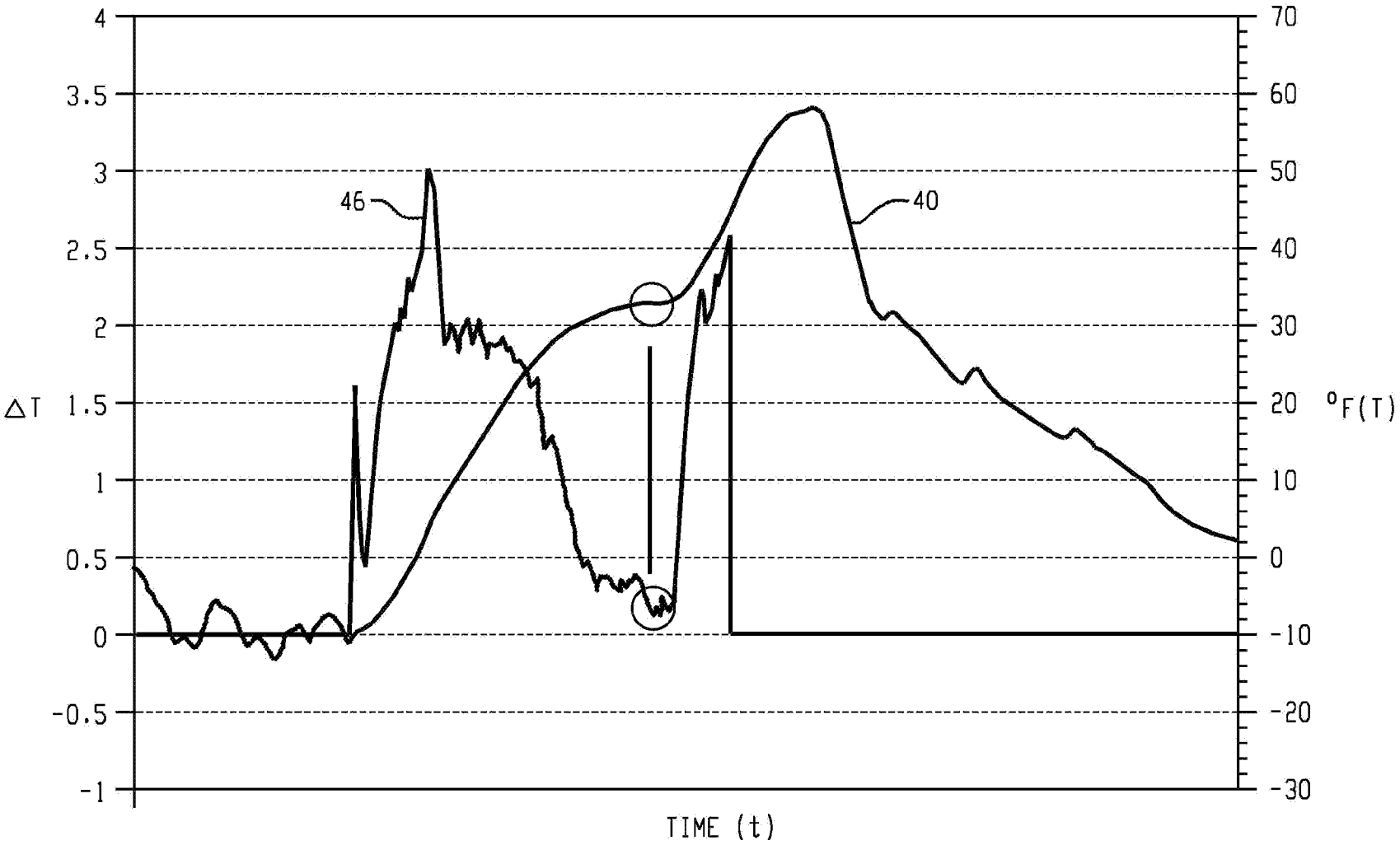
FIG. 4 is a graph of temperature sensor output during a defrost operation and first derivative of the same, for a functioning temperature sensor.
Figure 5:
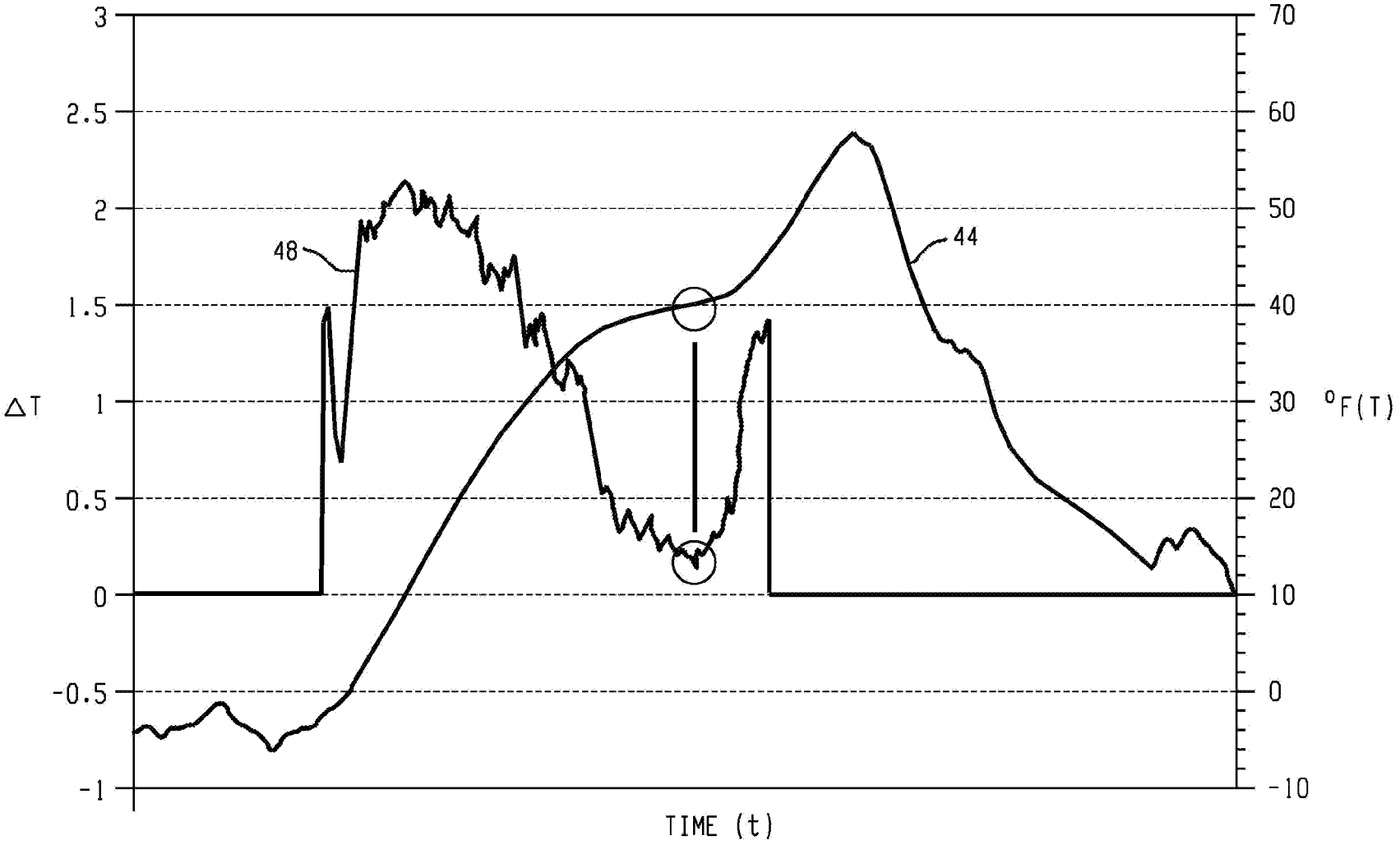
FIG. 5 is a graph of temperature sensor output during a defrost operation and first derivative of the same, for a faulty temperature sensor.

During a defrost operation, heat is applied to melt any frost or ice that has accumulated on the evaporator coil. Since the objective is to turn solid frost/ice to liquid, a phase change occurs. The phase change for water to go from solid to liquid always occurs at 32° F. at standard atmospheric pressure. FIG. 2 shows a curve 40 of the indicated change in evaporator temperature during a defrost operation when the sensor 34 is operating properly, where a defrost command signal 42 is also shown. As expected, the indicated temperature rises rapidly and the rise temporarily slows and stops at about 32° F. during the phase change, and then rises rapidly again after the phase change is complete. On the other hand, FIG. 3 shows a curve 44 of the indicated change in evaporator temperature during a defrost operation when the sensor 34 is reading higher than actual. Here, the indicated temperature rises rapidly and the rise temporarily slows and stops at about 40° F. during the phase change, and then rises rapidly again after the phase change is complete. The graph in FIG. 4 shows the temperature change curve 40 of FIG. 2 in combination with a curve 46 showing the first derivative of curve 40. The graph in FIG. 5 shows the temperature change curve 44 of FIG. 3 in combination with a curve 48 showing the first derivative of curve 44. The circles on the FIGS. 4 and 5 graphs depict when the phase change is occurring.

Thus, these graphs (FIGS. 2-5) suggest that the phase change temperature can be used to check the accuracy of any temperature sensor that is installed in the evaporator that is subject to frost accumulation and the defrost operation. In this regard, the controller 100 may continually detect (e.g., detect every five seconds, every ten seconds, or some other regular time interval) and store the temperature indicated by the sensor 34 so that a rolling cache or window of indicated temperatures for a preceding time period (e.g., 30-40 minutes) is maintained at all times.

Figure 6:
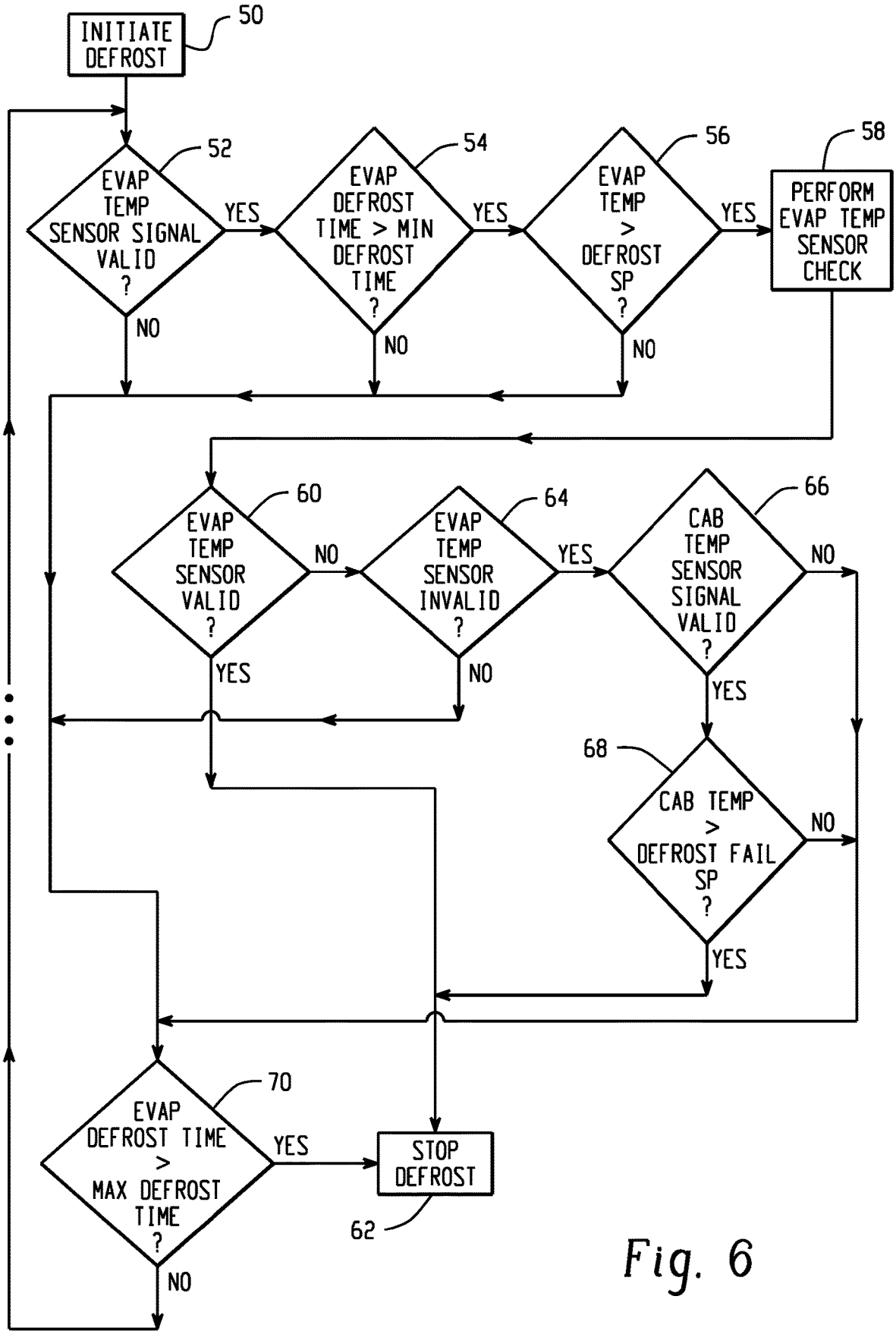
FIG. 6 is a flow chart of defrost control logic.
Figure 7:
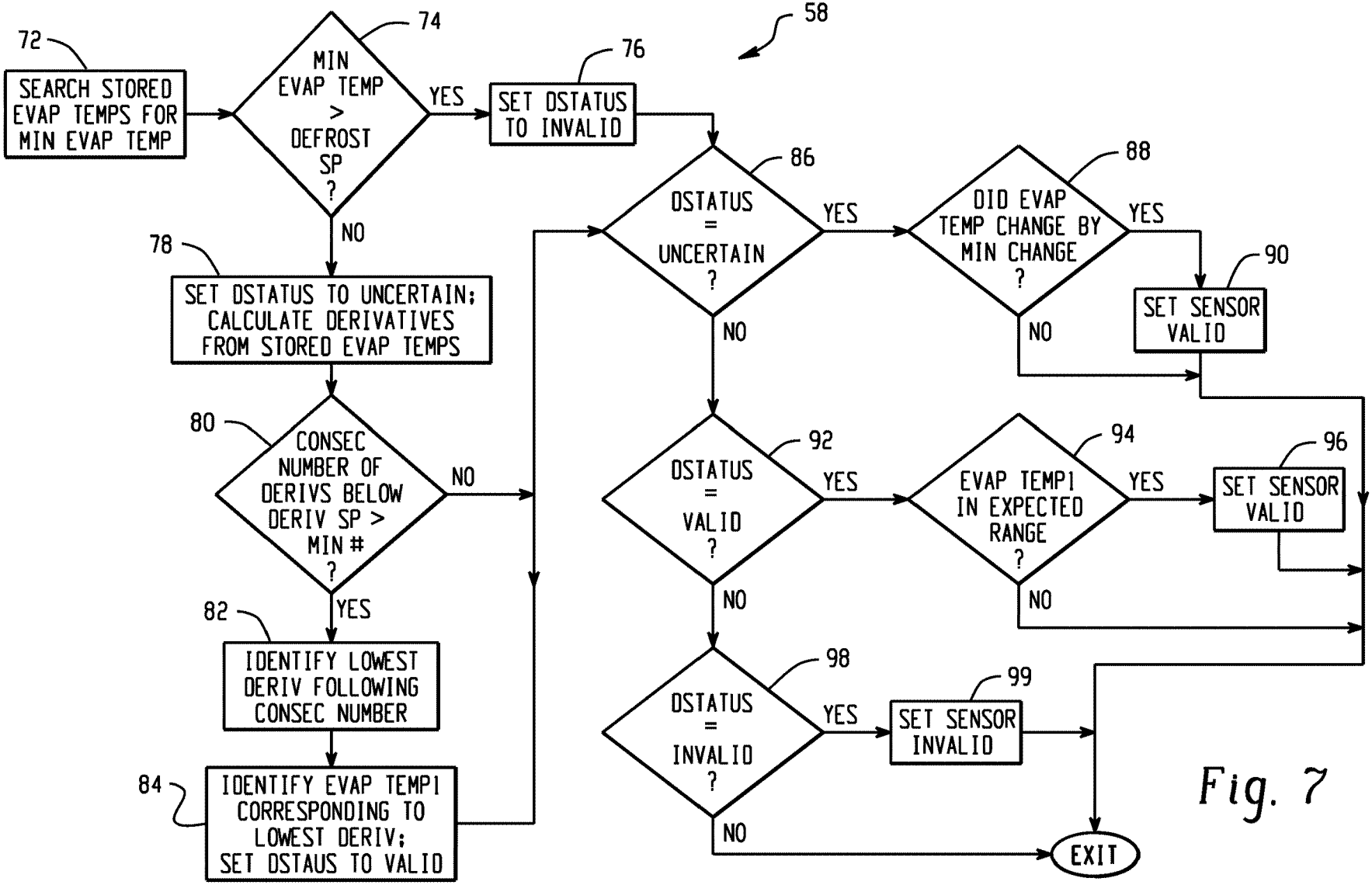
FIG. 7 is a flow chart of evaporator temperature sensor diagnostic logic.

FIGS. 6 and 7 depict exemplary logic of the controller 100 to check the status of the evaporator temperature sensor 34 during defrost and responsively control cessation of the defrost operation based upon whether the temperature sensor 34 is identified as functioning properly or not. Per FIG. 6, initiation of defrost occurs per step 50. The remaining steps in FIG. 6 are implemented to determine when to stop the current defrost operation.

At step 52, the controller checks the signal from the sensor 34 to determine if the signal is valid. A short circuit or open circuit condition of the sensor 34 is easily identified, in which case the no path is followed. However, if the signal is valid the yes path is followed and, at step 54, the controller determines whether a run time for the current defrost operation (Evap Defrost Time) is greater than a minimum acceptable defrost time (Min Defrost Time). If not, the no path is followed. However, if the run time is greater than the minimum acceptable run time, the yes path is followed and, at step 56, the controller determines whether the current temperature indication from the sensor 34 (Evap Temp) is above the defrost set point temperature (Defrost SP, which may be around 42° F. as indicated above). If not, the no path is followed. However, if the current temperature indication from the sensor 34 is above the defrost set point temperature, the yes path is followed, and at step 58 a diagnostic check of the temperature sensor 34 is carried out. Thus, in the illustrated embodiment, the diagnostic check only occurs after the evaporator temperature sensor 34 is providing a temperature reading that might be used to trigger termination of the defrost operation, assuming the temperature sensor 34 is working properly.

The diagnostic check 58 is subject of FIG. 7, to be discussed below, and will return a result indicating that the evaporator temperature sensor is valid (not faulty), that the evaporator temperature sensor is invalid (faulty) or neither a valid or invalid indication, meaning that the status of the evaporator temperature sensor is uncertain. Per step 60, if the diagnostic reflects that the evaporator temperature sensor is valid, the yes path is followed the defrost operation is stopped per step 62. If the diagnostic does not reflect that the evaporator temperature sensor is valid, then at step 64 the controller determines if the diagnostic reflected that the temperature sensor is invalid. If invalid, then the temperature sensor 34 should not be relied upon to terminate the current defrost operation, and at steps 66 and 68 the cabinet temperature sensor 32 is checked for valid signal and temperature indication. If the signal is valid and the indicated cabinet temperature (Cab Temp) is above a defrost fail set point (Defrost SP), then the defrost operation is stopped at step 62. The defrost fail set point may be, for example, a temperature in refrigerated space 14 that is viewed as too high (for example, 36° F.). If the signal from sensor 32 is not valid at step 66, or if the cabinet temperature is not above the defrost fail set point at step 68, the no paths are followed to step 70. At step 70, the controller determines whether the run time for the current defrost operation (Evap Defrost Time) exceeds the maximum permitted defrost time (Max Defrost Time) and, if so, defrost is terminated at step 62. If the maximum permitted defrost time is not exceeded, the no path is followed, and the sequence of steps (beginning at 52) will be rerun (either immediately or after some other intermediate logic is carried out).

Regardless of the basis used to stop the defrost operation, the stop will typically involve turning off the heat source 36. As indicated above, a time period can then be permitted to elapse to wait for water to drip off the evaporator, the compressor may be run to pre-cool the evaporator coil until the evaporator coil temperature is below the pre-cool set point and then the compressor and the evaporator are run fan until cabinet temperature is below cabinet operating set point.

Referring now to FIG. 7, an exemplary sequence for the diagnostic check 58 is shown. At step 72, the rolling window of stored evaporator temperatures is checked to determine the minimum temperature indicated (Min Evap Temp). At step 74, the controller determines whether that minimum temperature is above the defrost termination set point temperature (Defrost SP). If so, this is an indication that the temperature sensor 34 is reading much too high, and is therefore likely faulty, and at step 76 the controller identifies a diagnostic variable (DStatus) as invalid. At step 74, if the no path is followed, to identify if/when a rate of change in temperature indicated by the evaporator temperature sensor 34 satisfies a set rate of change condition.

In particular, at step 74 the variable DStatus is set to uncertain and derivatives of the curve represented by the rolling window of temperatures are calculated. The first derivative (rate of change) can be calculated in several ways. For example, as a difference between two sequential temperature readings gathered at some known time interval ($\Delta T$). As another example, the slope can be determine for a sequential set of temperature readings (e.g., 5 or ten readings) using a Least Squares Fit calculation. Regardless of technique, there may a minimum number of initial temperature samples, corresponding to the beginning of the defrost (e.g., first 2-3 minutes), that are not used to determine derivative values. When a defrost operation takes place, the compressor and evaporator fan are turned off, and the defrost heater is turned on. This transition could introduce transients in first derivative of the evaporator temperature. The hold-off period is to ensure the evaporator temperature has reached a steady-state condition, and that any change seen in the evaporator temperature is due only to the defrost heater.

The calculated derivatives, which represent the rate of change in indicated evaporator temperature, are then assessed at step 80 to determine whether there are consecutive number of derivative values below a threshold derivative set point (Deriv SP, where a derivative below Deriv SP is indicative of phase change) and in excess of a minimum number of desired consecutive readings (Min #). This check is intended to assure that a single or small number of readings of low derivative values, which could be mere data blips or transients, are not relied upon as an indication of phase change actually occurring. If the minimum number of low derivative values is satisfied, then at step 82 the lowest derivative value following the consecutive number of low derivative values is identified. This lowest derivative value is considered to occur at the phase change time point, and in step 84 the actual evaporator temperature indicated by the sensor 34 at the phase change time point is identified as value Evap Temp1, and the diagnostic variable DStatus is set to valid.

At step 86, if the diagnostic variable DStatus is uncertain (meaning the no path from step 80 was followed), then at step 88 the controller determines whether the temperature indicated by the evaporator temperature sensor changed by an amount greater than some minimum expected change (Min Change, which may, for example, be a temperature differential of 10° F.). If the minimum change did occur, then evaporator temperature sensor is identified as, and set as valid (which will cause the yes path to be followed in step 60 of FIG. 6), otherwise no valid or invalid indication for sensor is set.

If the diagnostic status variable DStatus is not uncertain at step 86, then, at step 92, the variable DStatus is checked to determine whether it was set to valid. If so, at step 94 the controller evaluates whether the actual evaporator temperature indicated by the sensor 34 at the phase change time point (Evap Temp1) is within an expected range of temperatures (Expected Range). The range of temperatures should encompass the expected phase change temperature of 32° F. and, by way of example a range of 30° F. to 34° F. could be used. If Evap Temp1 is in the expected range, then the evaporator temperature sensor is identified as, and set as valid at step 96 (which will cause the yes path to be followed in step 60 of FIG. 6).

If the diagnostic status variable DStatus is not valid at step 92, then, at step 98 the variable is checked to determine whether it was set to valid. If so (meaning that steps 82 and 84 were previously carried out), then the evaporator temperature sensor is identified as, and set as valid at step 99. Regardless of path followed, the Exit returns the logic to step 60 of FIG. 7.

Thus, the system and logic provide a method of automatically controlling a refrigerated device that includes refrigeration system with an evaporator and an evaporator temperature sensor, where the method involves: (a) monitoring an output of the evaporator temperature sensor; (b) based upon monitored temperatures from step (a), identifying when a rate of change in temperature indicated by the evaporator temperature sensor satisfies a set rate of change condition and determining if a temperature indicated by the evaporator temperature sensor when the rate of change satisfies to the set rate of change condition is consistent with a predefined expected temperature condition; (c) if the temperature indicated by the evaporator temperature sensor is consistent with the predefined expected temperature condition, taking a first refrigeration control action; and (d) if the temperature indicated by the evaporator temperature sensor is not consistent with the predefined expected temperature condition, taking a second refrigeration control action that is different than the first refrigeration control action.

Step (a), in the embodiment, is carried out during an evaporator defrost operation during which heat is applied to defrost the evaporator. In step (b), the set rate of change condition is satisfied based at least in part upon the rate of change in temperature indicated by the evaporator temperature sensor falling below a set rate of change level. In addition, the set rate of change condition is satisfied based at least in part upon the rate of change in temperature indicated by the evaporator sensor repeatedly being below the set rate of change level (e.g., at least Min # per FIG. 7 step 80). Step (b) involves comparing the temperature indicated by the evaporator temperature sensor 34 when the rate of change satisfies to the set rate of change condition (e.g., Evap Temp1 from FIG. 7 step 84) to the predefined expected temperature condition (e.g., Expected Range from FIG. 7 step 94). Step (c) involves identifying a valid temperature state of the evaporator temperature sensor (e.g., per FIG. 7 step 96). Step (d) involves identifying an invalid temperature state of the evaporator temperature sensor (e.g., per FIG. 7 step 99). In the described embodiment, the first refrigeration control action is termination of the evaporator defrost operation based upon the temperature indicated by the evaporator temperature sensor (e.g., per FIG. 6 yes path from step 60), and the second refrigeration control action is termination of the evaporator defrost operation based upon a control condition that is not the temperature indicated by the evaporator temperature sensor (e.g., (i) termination as a result of yes path from FIG. 6 step 68, meaning the control condition is a temperature of a refrigerated cabinet that is cooled by the refrigeration system exceeding a set maximum cabinet defrost temperature termination, or (ii) termination as a result of yes path from FIG. 6 step 70, meaning duration of the evaporator defrost operation exceeding a set maximum defrost time).

It is to be clearly understood that the above description is intended by way of illustration and example only, is not intended to be taken by way of limitation, and that other changes and modifications are possible.

What is claimed is:

1. A method of automatically controlling a refrigerated device that includes a refrigeration system with an evaporator and an evaporator temperature sensor, the method comprising:

(a) monitoring an output of the evaporator temperature sensor during an evaporator defrost operation during which heat is applied to defrost the evaporator;

(b) based upon monitored temperatures from step (a), (b1) identifying when a rate of change in temperature indicated by the evaporator temperature sensor satisfies a set rate of change condition, and (b2) determining if the temperature indicated by the evaporator temperature sensor when the rate of change satisfies the set rate of change condition is consistent with a predefined expected temperature condition;

(c) if the temperature indicated by the evaporator temperature sensor is not consistent with the predefined expected temperature condition, identifying the evaporator temperature sensor as faulty and terminating the defrost operation based upon a control condition that is not the temperature indicated by the evaporator temperature sensor.

2. The method of claim 1, wherein:

in step (b), the set rate of change condition is satisfied based at least in part upon the rate of change in temperature indicated by the evaporator temperature sensor falling below a set rate of change level.

3. The method of claim 2, wherein:

in step (b), the set rate of change condition is satisfied based at least in part upon the rate of change in temperature indicated by the evaporator sensor repeatedly being below the set rate of change level.

4. The method of claim 2, wherein:

step (b2) involves comparing the temperature indicated by the evaporator temperature sensor when the rate of change satisfies the set rate of change condition to the predefined expected temperature condition;

step (c) involves identifying an invalid temperature state of the evaporator temperature sensor.

5. The method of claim 2, wherein the predefined expected temperature condition is an expected temperature range.

6. The method of claim 1, wherein the control condition is one of (i) a duration of the evaporator defrost operation exceeding a set maximum defrost time or (ii) a temperature of a refrigerated cabinet that is cooled by the refrigeration system exceeding a set maximum cabinet defrost temperature.

7. The method of claim 2, wherein steps (b) through (c) are only carried out after the temperature indicated by the evaporator temperature sensor rises to a set defrost complete set point.

8. A refrigerated cabinet, comprising:

a housing defining a space for holding product;

a refrigeration system for cooling the space, the refrigeration system including an evaporator and an evaporator temperature sensor;

a heat source for applying heat to the evaporator during an evaporator defrost operation;

a controller for controlling the refrigeration system and the heat source, the controller configured to:

(i) monitor temperatures indicated by the evaporator temperature sensor during the evaporator defrost operation, (ii) based upon the monitored temperatures, identify a temperature indicated by the evaporator temperature sensor when a rate of change in temperature indicated by the evaporator temperature sensor satisfies a set rate of change condition, (iii) compare the identified temperature to a predefined expected temperature condition, determine that the evaporator temperature sensor is faulty if the identified temperature is not consistent with the predefined expected temperature condition; and (iv) as a result of determination that the evaporator temperature sensor is faulty, stop the evaporator defrost operation based upon a control condition that is not based upon the temperature indicated by the evaporator sensor.

9. The refrigerated cabinet of claim 8, wherein the predefined expected temperature condition is satisfied if the identified temperature falls within a temperature range from 30-34 degrees Fahrenheit.

10. The refrigerated cabinet of claim 8, wherein the control condition is one of (i) a duration of the evaporator defrost operation exceeding a set maximum defrost time or (ii) a temperature of the refrigerated cabinet exceeding a set maximum cabinet defrost temperature.

* * * * *